US007485007B1

(12) United States Patent
Nee

(10) Patent No.: US 7,485,007 B1
(45) Date of Patent: Feb. 3, 2009

(54) SWIVELING OFFSET ADAPTER DONGLE FOR REDUCING BLOCKAGE OF CLOSELY-SPACED VIDEO CONNECTORS

(75) Inventor: Henry P. Nee, Coto De Caza, CA (US)

(73) Assignee: Pericom Semiconductor Corp., San Jose, CA (US)

( * ) Notice: Subject to any disclaimer, the term of this patent is extended or adjusted under 35 U.S.C. 154(b) by 35 days.

(21) Appl. No.: 11/749,311

(22) Filed: May 16, 2007

(51) Int. Cl.
*H01R 25/00* (2006.01)

(52) U.S. Cl. ..... 439/640; 439/11

(58) Field of Classification Search ..... 439/11, 439/13, 638, 171, 164, 165, 640; 361/752, 361/736, 728

See application file for complete search history.

(56) References Cited

U.S. PATENT DOCUMENTS

| | | | | |
|---|---|---|---|---|
| 4,165,912 | A | 8/1979 | Dyste et al. | |
| 5,199,904 | A | 4/1993 | Wharton | |
| D360,400 | S | 7/1995 | Pitcher | |
| D408,384 | S | 4/1999 | Hata et al. | |
| 6,100,936 | A | 8/2000 | Jordan et al. | |
| 6,128,741 | A | 10/2000 | Goetz et al. | |
| 6,283,804 | B1 | 9/2001 | Weingartner | |
| 6,343,957 | B1 | 2/2002 | Kuo et al. | |
| 6,624,797 | B1 | 9/2003 | Wheeler et al. | |
| D481,392 | S | 10/2003 | Dyer et al. | |
| D486,829 | S | 2/2004 | Wang et al. | |
| 6,753,881 | B1 | 6/2004 | Callway et al. | |
| 6,790,094 | B1 | 9/2004 | Bergmann et al. | |
| 7,059,917 | B1 | 6/2006 | Tsai | |
| 7,172,428 | B2 * | 2/2007 | Huang | 439/11 |
| 2004/0242032 | A1 | 12/2004 | Liu et al. | |
| 2005/0137018 | A1 | 6/2005 | Dernis et al. | |
| 2006/0203842 | A1 | 9/2006 | Wollmershauser et al. | |
| 2006/0236131 | A1 | 10/2006 | Vauclair | |

* cited by examiner

*Primary Examiner*—Felix O Figueroa
(74) *Attorney, Agent, or Firm*—Stuart T. Auvinen; g Patent LLC

(57) ABSTRACT

A swivel adapter connects plugs for different video-connector standards. A smaller Display-Port (DP) connector fits into ports on a personal computer or other device, while a larger Digital Visual Interface (DVI) connector connects to a display or other device through a standard cable. When computer DP ports are tightly spaced, the wider DVI end of the swivel adapter can be twisted to make room for other DP plugs to fit into other DP ports on the computer. A swivel mechanism is located within the adapter body between DP-connector and DVI-connector ends of the adapter body. A swivel joint between the two ends rotates as the swivel mechanism is twisted. Two circuit boards in either end are connected together through the swivel joint by flex lines or a flexible circuit board. A converter chip on one circuit board converts signals between the DP and DVI formats.

19 Claims, 10 Drawing Sheets

SWIVELING OFFSET ADAPTER DONGLE FOR REDUCING BLOCKAGE OF CLOSELY-SPACED VIDEO CONNECTORS

FIELD OF THE INVENTION

This invention relates to computer cables, and more particularly to flexible cables for restricted-clearance plugs.

BACKGROUND OF THE INVENTION

Cables are often used to connect sub-systems together in a computer such as in a personal computer (PC). For example, the video display monitor may connect to the main PC box using a video display cable, or a video camera may upload video to the PC over a video adapter cable.

The two plug connectors on the ends of the video cable often differ in physical size, shape, and pin arrangement. Different protocol and plug standards may be used for the different ends of the cable. A small circuit board or chip may be embedded within the cable or with one of its plugs to convert signals, or simple cross-over wiring or connections may be used for format conversion.

FIG. 1 shows a prior art dongle. Sometimes the length of the cables are shortened to form a dongle. The dongle is used as an adapter between a longer cable and a plug in a PC or other device. The dongle converts plug formats, allowing the longer cable to use the same connector on both ends.

Digital Visual Interface (DVI) connector 16 connects to a DVI plug in a PC or other device. DVI is a standard developed by the Digital Display Working Group especially for carrying uncompressed digital data to a flat panel display or to a digital projector, rather than to an analog cathode-ray tube (CRT) display. DVI connectors have 29 pins and can carry red, blue, and green signals, either in digital or analog formats, along with a clock to sync the signals. Other information may be carried, such as configuration or display data channel. Transition-minimized differential signaling (TMDS) is used for higher bandwidth using differential signals, such as true (+) and complement (−) clock signals.

Display Port (DP) connector 18 connects to a display port receptacle or plug on a PC or on a display device. Display Port (DP) is a new standard from the Video Electronics Standards Association (VESA) for a digital audio/video interconnect. DP is especially useful for connecting a PC to a display monitor or to a home theater system. Transfer rates of 1.62 or 2.7 gigabits per second are currently supported, with 8 or 10 bit pixels per color channel. Encryption and digital-rights-management (DRM) is optionally supported.

The physical sizes and shapes of DVI connector 16 and DP connector 18 differ, with DVI connector 16 being larger than DP connector 18. DVI housing 10 supports DVI connector 16, while DP housing 12 supports DP connector 18. Flexible cable 14 between DP housing 12 and DVI housing 10 allows the user to grab DP housing 12 and insert DP connector 18 into a cable when DVI connector 16 is plugged into a PC.

The flexibility of cable 14 helps compensate for the difference in physical sizes of DVI connector 16 and DP connector 18, since the exact location of DVI connector 16 can move somewhat. However, the relatively limited movement of round flexible cable 14, especially when cable 14 is short, restricts the use of the dongle, as adjacent plugs on the PC next to the plug that DP connector 18 is plugged into can be blocked by the dongle.

FIG. 2 shows a prior-art fixed adapter. Rather than form a dongle with a flexible cable, the adapter can be formed as a rigid unit. Thumbscrews 22 in rigid body 20 can be screwed into holes in the PC or display device to secure DVI connector 16 into the matching plug or receptacle in the PC. DP connector 18 is fixed to the back of rigid body 20, allowing a cable to be plugged in.

However, when DP connector 18 is plugged into a PC, the larger size of DVI connector 16 may block access to adjacent connector receptacles on the PC. The bulk of rigid body 20 can prevent other available ports on the PC from being used, or can make it extremely difficult if not impossible for a user to plug additional devices into the PC.

FIG. 3 shows an adjacent port being blocked by a bulky adapter. Ports 26, 26' are plug receptacles on a PC or other device that have a spacing of S as shown. The spacing S is relatively tight, but is sufficient for several plugs such as DP connector 18 when the specification is followed. However, DP connector 18 is part of adapter body 24, which widens to support DVI connector 16 which is a wider connector. DVI extension end 28 of adapter body 24 infringes into the spacing above and between ports 26, 26', as shown by the dashed lines extending above ports 26, 26'. While a very short second plug could theoretically be plugged into port 26', the cable extending from the second plug would likely bump into DVI extension end 28 of adapter body 24. Thus second port 26' is likely unusable since it is effectively blocked by DVI extension end 28 of adapter body 24.

FIG. 4 shows a DVI/DP adapter with a rotated DP connector. DVI connector 16 and DP connector 18 are rotated by 90 degrees to each other. DVI connector 16 is supported by DVI end 32 while DP connector 18 is supported by DP end 34 of adapter 30. Since DVI connector 16 and DP connector 18 are rotated by 90 degrees, ends 32, 34 also are in a rotated arrangement. This rotated arrangement may allow for better accessing of adjacent ports. However, the small length of adapter 30 may still cause adjacent ports on a PC or other device to be blocked. The rigid connection of ends 32, 34 may limit usefulness of adapter 30.

While such adapters and dongles are useful, blockage of adjacent ports on a PC are problematic. The adapters must widen to support the larger DVI connector 16, and this widening can block the space above and adjacent port on the PC. The limited flexibility of a dongle cable can still block adjacent ports, and the flexibility of the cable can cause the connection to loosen and fail over time.

What is desired is an adapter for video connectors such as DP and DVI. An adapter that does not block adjacent ports on a PC or other device is desired. An adapter with a larger end that can be easily moved away from a shadowing position is desired.

DETAILED DESCRIPTION

The present invention relates to an improvement in video adapters. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The inventor has discovered that a video adapter can have an offset rather than a symmetric shape. One connector may be placed at an offset to the other connector, rather than have both connectors symmetrically placed along the same axis. This offset can facilitate access to closely-spaced ports on a PC or other device.

The inventor further realizes that a swivel mechanism may be added to the adapter to allow the relative locations of the two connectors to be adjusted to best fit the environment of the ports on the PC or other device. the swivel allows for the rotation of one connector relative to the other connector. Since a swivel mechanism is used rather than a rigid adapter body, the user can adjust the angle between the two connectors. Since the swivel mechanism does not flop around, connections do not loosen over time as can occur with flexible-cable dongles.

Figure 1:
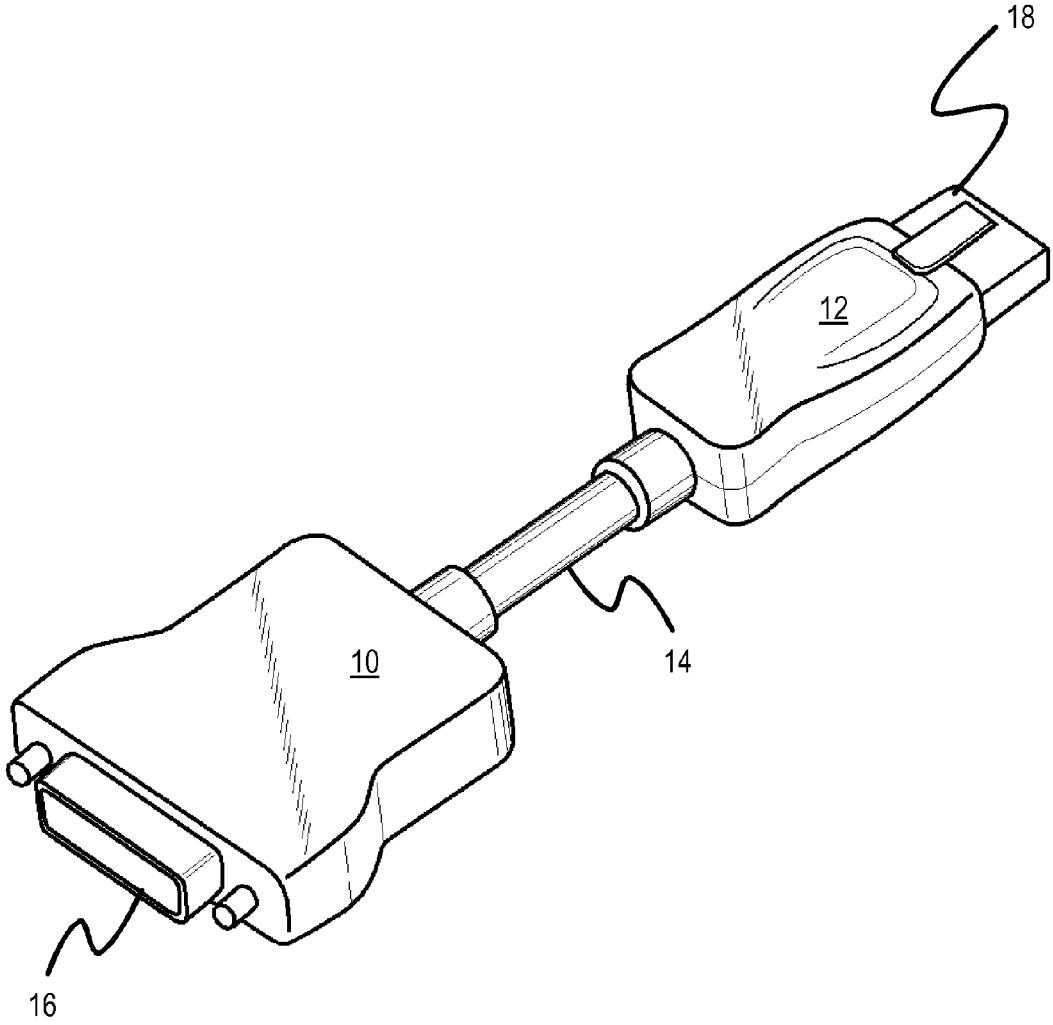
FIG. 1 PRIOR ART
FIG. 1 shows a prior art dongle.
Figure 2:
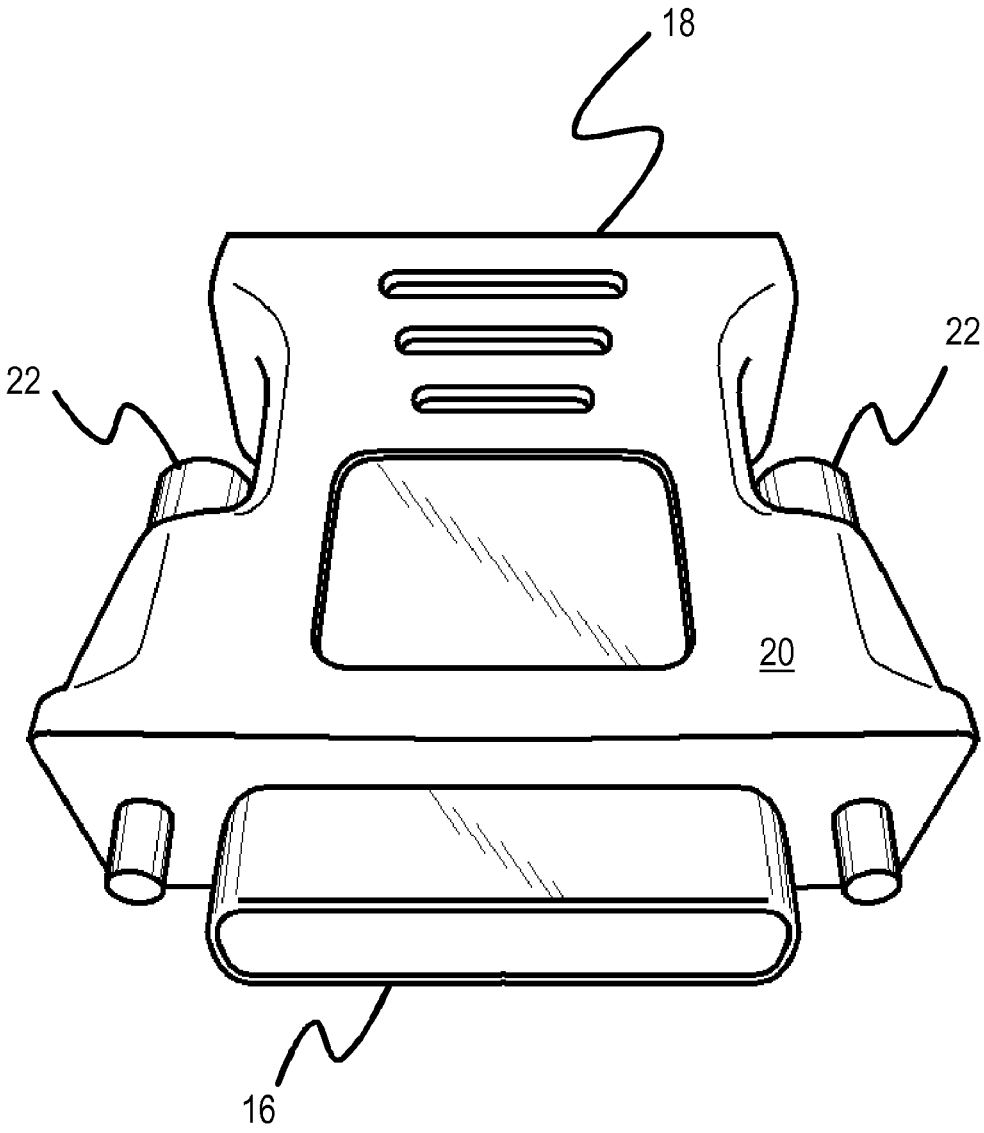
FIG. 2 PRIOR ART
FIG. 2 shows a prior-art fixed adapter.
Figure 3:
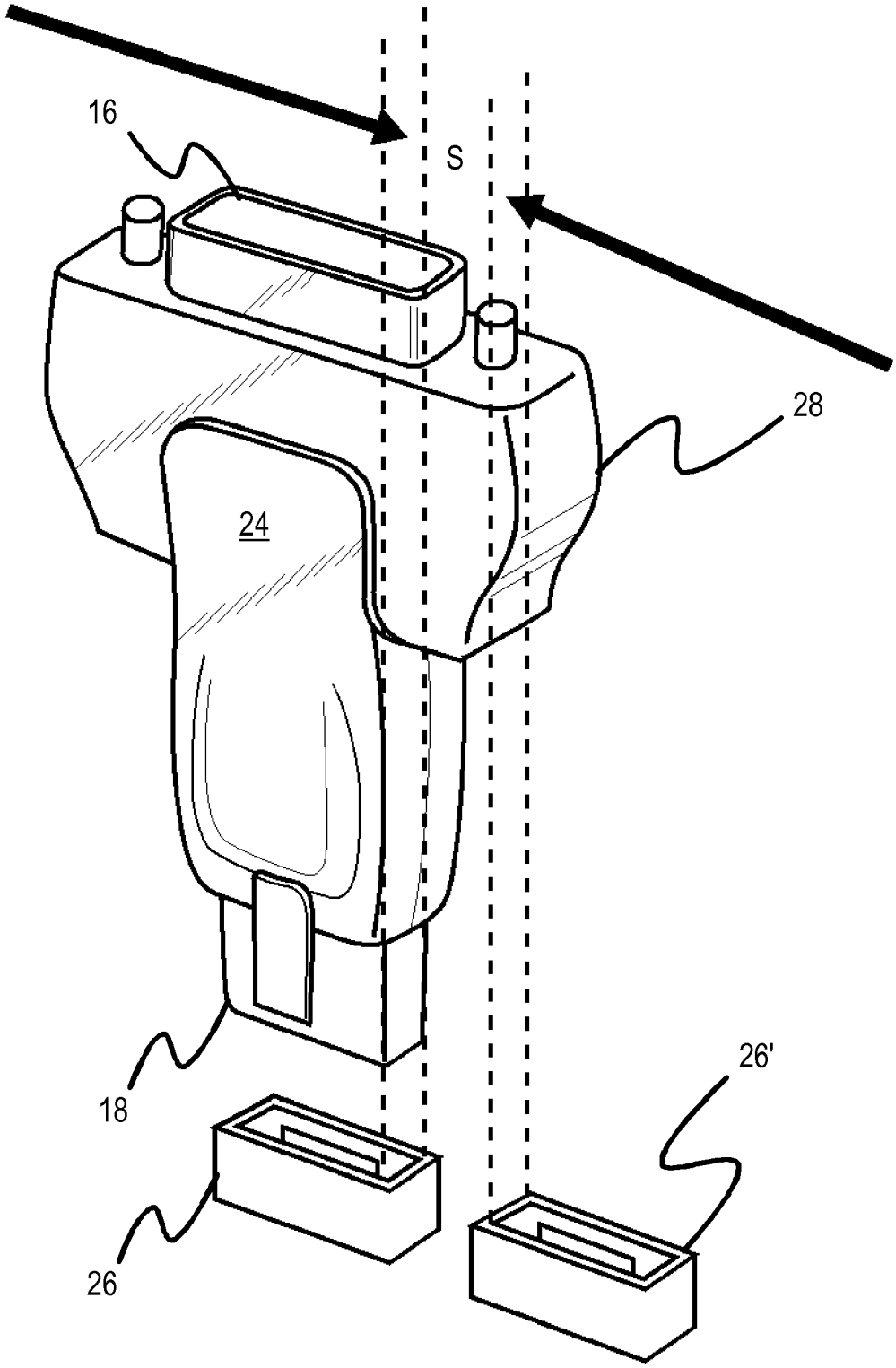
FIG. 3 PRIOR ART
FIG. 3 shows an adjacent port being blocked by a bulky adapter.
Figure 4:
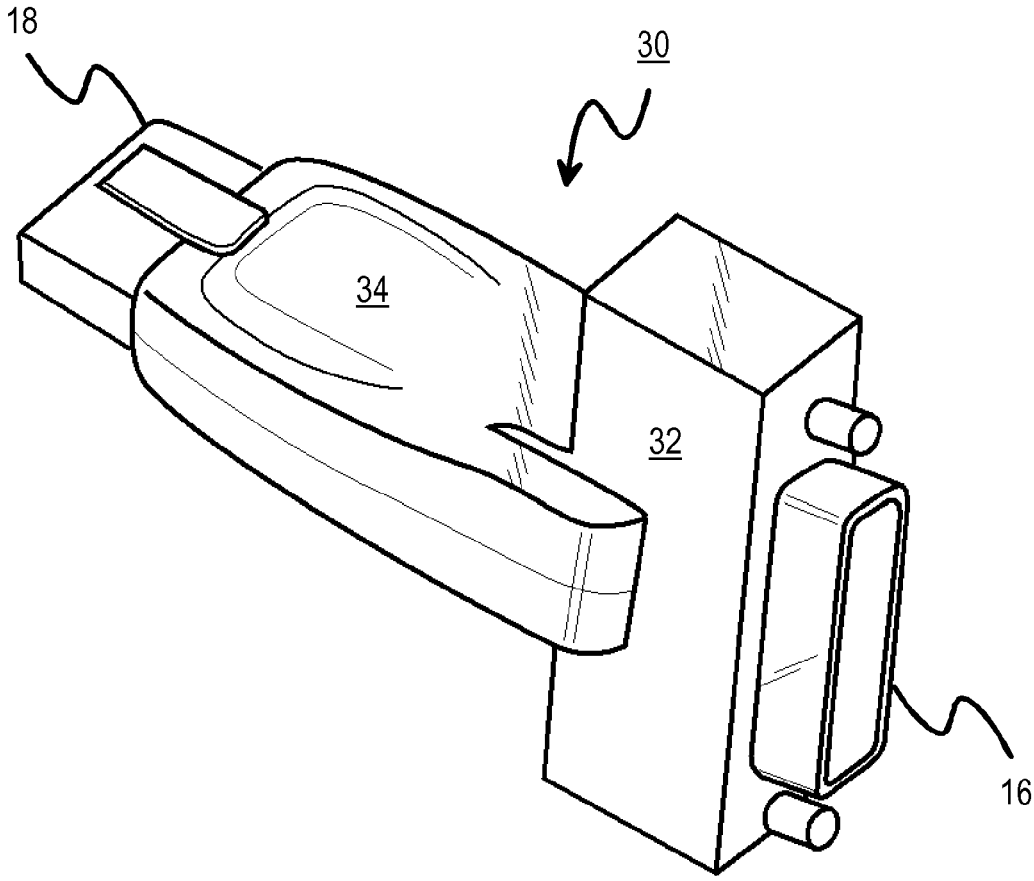
FIG. 4 PRIOR ART
FIG. 4 shows a DVI/DP adapter with a rotated DP connector.
Figure 5:
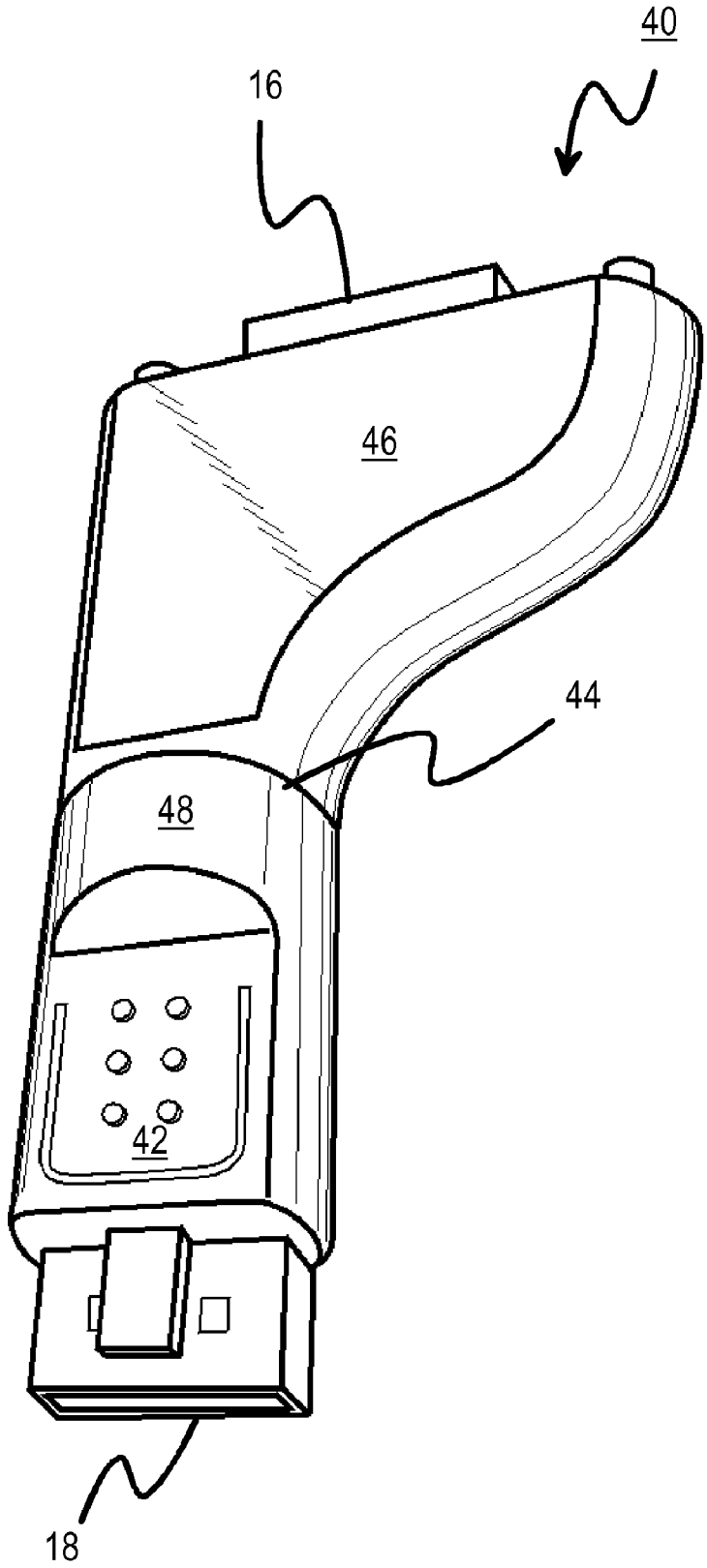
FIG. 5 shows a swivel adapter.

FIG. 5 shows a swivel adapter. Swivel adapter 40 adapts DP to DVI video standards. DVI connector 16 is supported on DVI end 46, while DP connector 18 is supported by DP end 42 of swivel adapter 40.

DVI connector 16 and DP connector 18 are not aligned along the same axis through swivel adapter 40. Instead, the smaller connector, DP connector 18, is located at an offset from the center axis through the larger connector, DVI connector 16. For example, DP connector 18 can be located near one end of DVI connector 16 when swivel adapter 40 is viewed from an overhead position over DP connector 18 and looking down toward DVI connector 16. This offset of the center axis of DVI connector 16 and DP connector 18 can allow for better access to tightly-spaced DP ports.

DP end 42 flares out somewhat to enclose part of swivel mechanism 48. Swivel joint 44 is a gap between DP end 42 and DVI end 46 of swivel adapter 40. Swivel joint 44 can be rotated using swivel mechanism 48 to change the angle between DVI connector 16 and DP connector 18.

Figure 6:
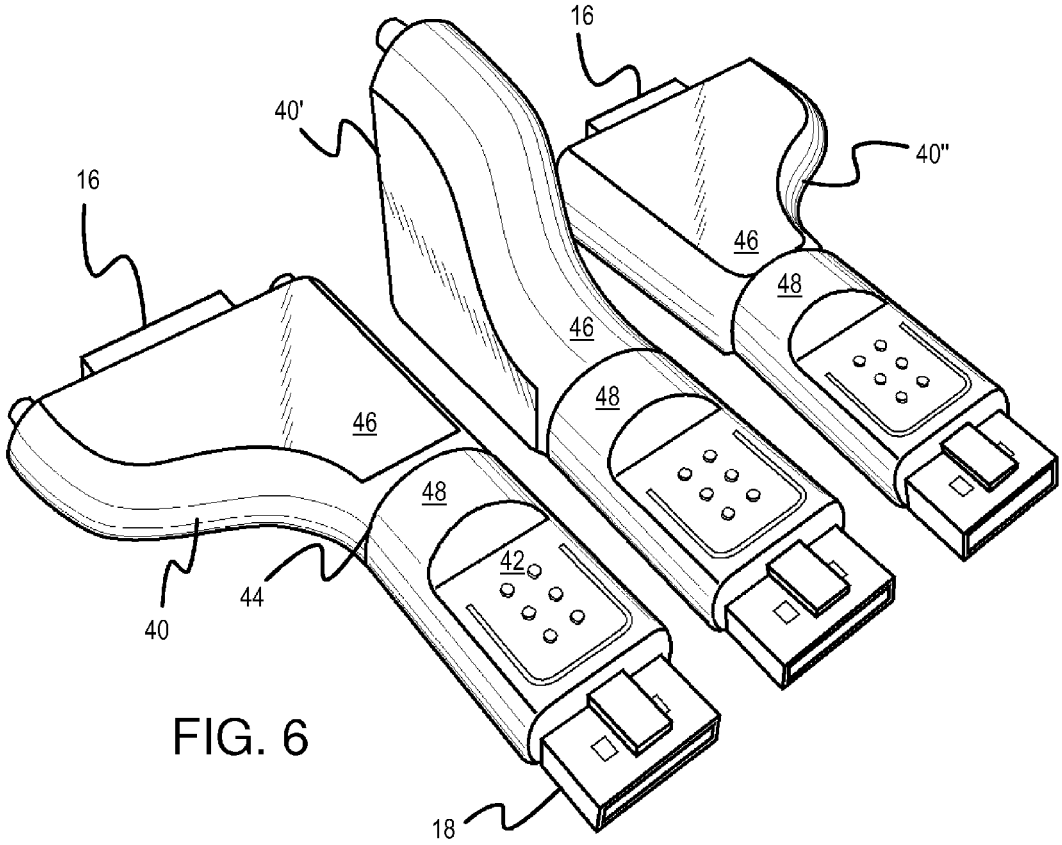
FIG. 6 shows the swivel adapter in three positions.

FIG. 6 shows the swivel adapter in three positions. On the left of FIG. 6, swivel adapter 40 is in the left position, with swivel mechanism 48 rotated to the left so that DP connector 18 is roughly aligned to the right edge of DP end 46. DVI connector 16 and DP connector 18 are parallel to each other, but offset.

In the center of FIG. 6, swivel adapter 40' is in the center position, with swivel mechanism 48 rotated halfway. DVI connector 16 and DP connector 18 are perpendicular to each other.

On the right of FIG. 6, swivel adapter 40" is in the right position, with swivel mechanism 48 rotated to the right so that DP connector 18 is roughly aligned to the left edge of DP end 46. DVI connector 16 and DP connector 18 are parallel to each other, but offset and in opposite orientations.

Figure 7:
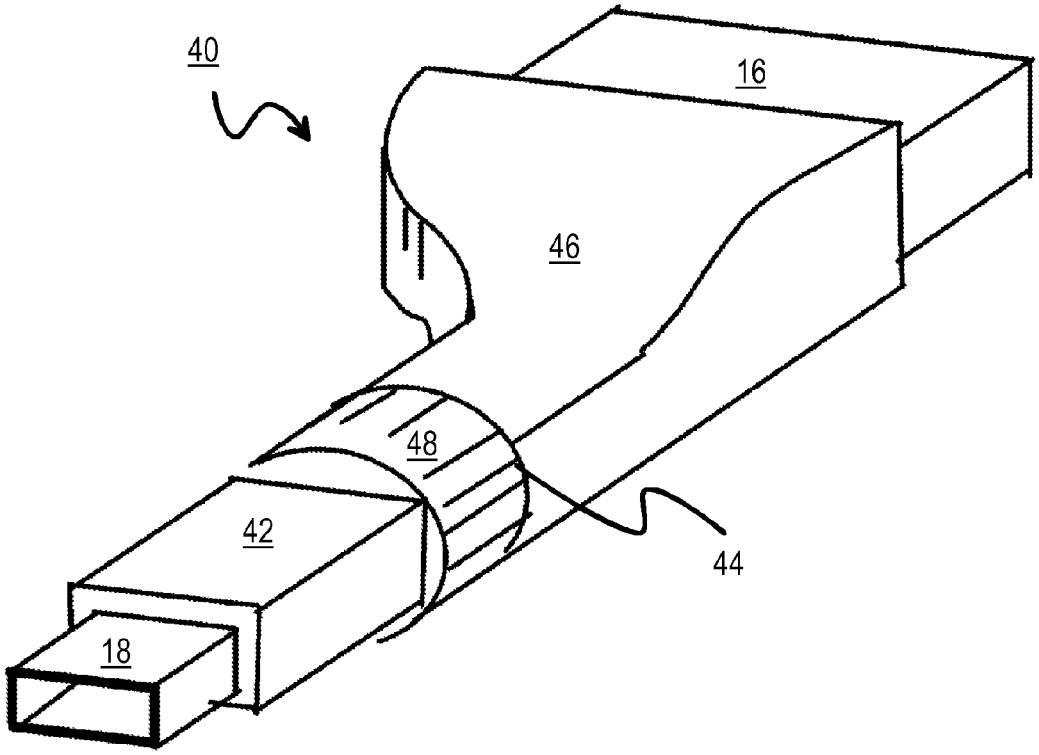
FIG. 7 is another diagram of the swivel adapter.

FIG. 7 is another diagram of the swivel adapter. DVI connector 16 is supported on wider DVI end 46, while DP connector 18 is supported by smaller DP end 42 of swivel adapter 40.

DVI connector 16 and DP connector 18 are offset, each being centered along different parallel axes through swivel adapter 40. This offset of the center axes of DVI connector 16 and DP connector 18 can allow for better access to tightly-spaced DP ports next to the port that DP connector 18 plugs into.

DP end 42 flares out somewhat to enclose part of swivel mechanism 48. DP end 42 can be relatively flat near DP connector 18, but round or cylindrical in shape around swivel mechanism 48 and at swivel joint 44. Ridges can be added to improve the user's grip when the user swivels DP end 42 relative to DVI end 46.

Swivel joint 44 is the gap between DP end 42 and DVI end 46 of swivel adapter 40. Swivel joint 44 can be rotated using swivel mechanism 48 to change the angle between DVI connector 16 and DP connector 18.

Figure 8:
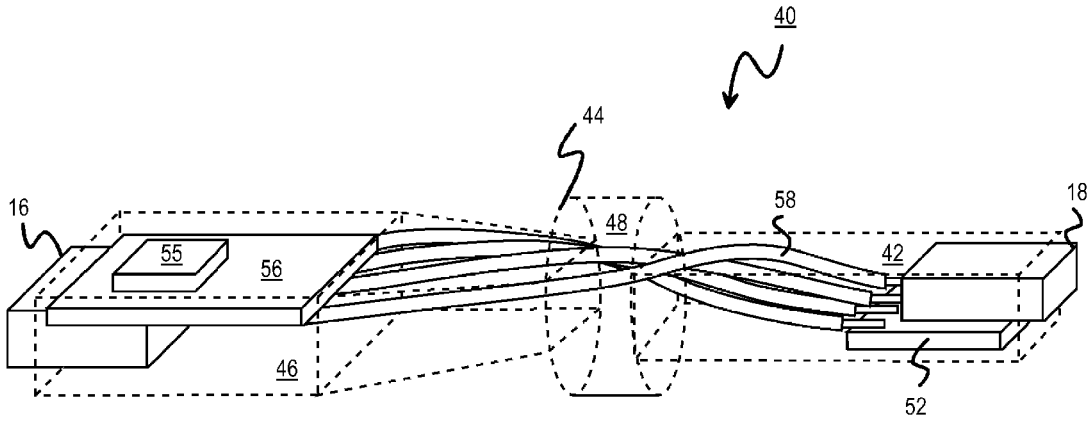
FIG. 8 shows the interior of the swivel adapter.

FIG. 8 shows the interior of the swivel adapter. Swivel adapter 40 converts DP signals to DVI signals. DVI connector 16 is mounted to first circuit board 56 that is embedded inside DVI end 46. Converter chip 55 is an integrated circuit (IC) that converts DVI signals to the DP format, and vice-versa. Wiring traces on first circuit board 56 connect signals from DVI connector 16 to converter chip 55 and to flex lines 58.

DP connector 18 is mounted to second circuit board 52, which is embedded inside DP end 42. Flex lines 58 are flexible wires that have their ends soldered to solder pads on first circuit board 56 and second circuit board 52. Flex lines 58 carry signals between circuit boards 52, 56. For example, four lines could be used for flex lines 58, including differential data and power and ground, or 6 lines could be used to also include a differential clock.

Flex lines 58 pass through the middle of swivel mechanism 48. As swivel joint 44 is rotated, flex lines 58 bend and twist around each other, allowing ends 42, 46 to swivel and change their relative orientation to each other.

Figure 9:
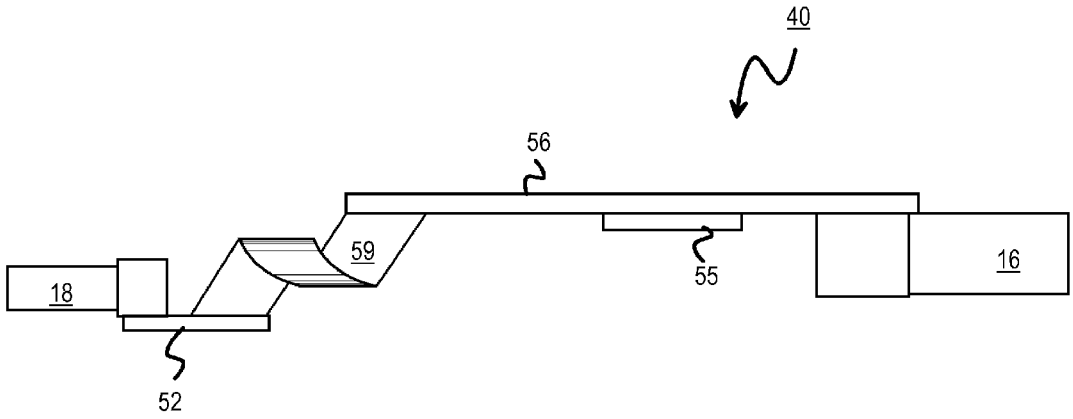
FIG. 9 is an alternative interior view using a flex board through the swivel adapter.

FIG. 9 is an alternative interior view using a flex board through the swivel adapter. Swivel adapter 40 converts DP signals to DVI signals using converter chip 55. DVI connector 16 is mounted to first circuit board 56 that is embedded inside the DVI end. Wiring traces on first circuit board 56 connect signals from DVI connector 16 to converter chip 55 and to flex lines 58.

DP connector 18 is mounted to second circuit board 52, which is embedded inside the DP end. Flex board 59 is a flexible circuit board with several wiring traces on it that connect to solder pads on first circuit board 56 and second circuit board 52. Flex board 59 carries signals between circuit boards 52, 56.

Flex board 59 passes through the middle of swivel mechanism 48. As swivel joint 44 is rotated, flex board 59 bends and twists, allowing DVI connector 16 and DP connector 18 to swivel and change their relative orientation to each other.

Figure 10:
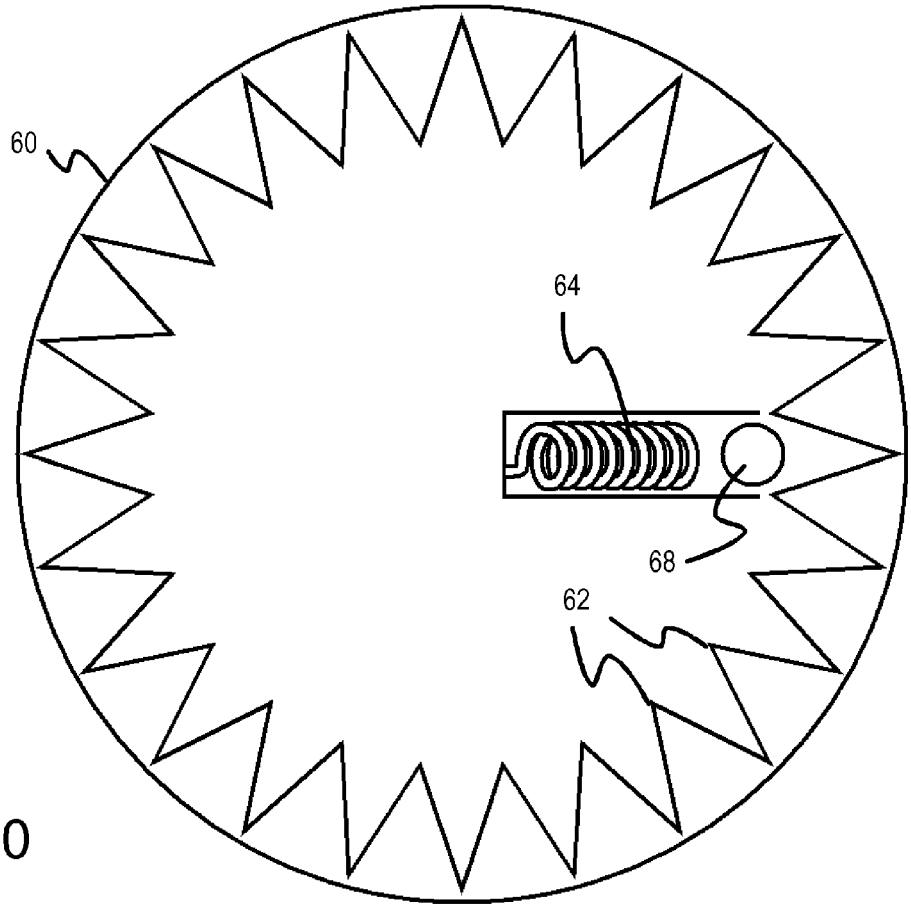
FIG. 10 shows a swivel mechanism for a swivel adapter.

FIG. 10 shows a swivel mechanism for a swivel adapter. Gear 60 is a ring with a hollow center that has teeth 62 formed along its interior circumference. Spring 64 is not attached to gear 60 but is fixed in position while gear 60 is rotated. Spring 64 pushes against ball 68, forcing ball 68 into the gaps between teeth 62 as gear 60 is rotated by the user. The user must exert some twisting force on gear 60 to allow ball 68 to jump over teeth 62 into the next gap. Once the user stops exerting the twisting force, ball 68 remains in position between two of teeth 62. Thus gear 60 remains in place after the user stops twisting.

Gear 60 can be attached to one end of the swivel adapter, such as DP end 42 (FIG. 5), while spring 64 is attached to the other end, such as DVI end 46. Spring 64 may be fitted inside a well or housing that is formed on the interior of the swivel adapter body.

The allowable degree of rotation can be limited by stops or other mechanisms. For example, a 180-degree rotation could be allowed, but not 270 degrees. Resistors, capacitors, other chips, or other devices could be soldered to one of the circuit boards. A display device such as a light-emitting diode (LED) could be added, along with a window, lite-pipe, or opening.

ALTERNATE EMBODIMENTS

Several other embodiments are contemplated by the inventor. For example, while a video adapter for DP and DVI standards has been described, other standards could be substituted. High-Definition Multimedia Interface (HDMI) could be used in place of DP. DVI is partially compatible with HDMI in some modes.

A dongle with a flat connection can also be used. Some types of flat flex circuit or ribbon may be foldable only at a 45 degree angle at the narrow neck between the two ends. When the cable forms a 45-degree fold across the neck, the result is that the DVI connector is pointed 90 degrees from the original Y axis, away from neighboring connectors. This implementation does not require a hard swivel mechanism. Instead, a ribbon cable or flat cable allows the 90-degree turn. Turns along the Y-axis may be prevented by the cable, thus forcing a 90-degree bend when a swivel pressure is applied. The flex-cable neck snaps into the 45-degree folded position when pressure is applied, rather than into intermediate positions. Flex board 59 of FIG. 9 may thus fold flat at a 90-degree angle rather than have the spiral loop shown in FIG. 9, causing circuit board 52 and connector 18 to be at a 90-degree angle (pointing downward in FIG. 9) to circuit board 56, rather than parallel as shown in FIG. 9. A flat flex circuit may be used, which can be a flat ribbon cable, or other kinds of flat flax circuits. The use of a flex circuit allows the circuit to be folded away, thus achieving greater mobility compared to a round cable.

The number of flex lines 58 may vary. Rather than have individual lines or wires, a bundle of wires could be used, or a ribbon cable, or a flexible circuit board with many traces. Ribbon, round, or flat cables could be used. The converter chip could be mounted on either circuit board.

Alternately, circuit boards 52, 56 could be combined on a single flexible circuit board that also includes a central section that fits through swivel mechanism 48 and twists. The central section could be narrower than the end sections that are soldered or otherwise attached to the video connectors. The central section can then be twisted or bent as the adapter is twisted around the swivel joint. Metal shields, trays, or stiffeners may be added to the ends sections of the long flexible board. The long flexible board may have multiple bends in it, even when the connectors are parallel to each other. A bending pigtail adapter can be produced. The bending ratio (the bend radius divided by the thickness of the flex board) can be larger than 10 in some embodiments. The assembly can be over-molded in soft rubber to facilitate bending and prevent damage and wear. Sub-assembly and one-piece fabrication methods can be used. Corners of the board and other parts can be rounded to prevent failure.

While the wider DVI end has been described as being rotated into a position that is perpendicular to the narrower DP end, the perpendicular position does not have to be exactly 90 degrees, but could vary somewhat, such as being +/−5 degrees, or even 70 degrees to 110 degrees, or some other tolerance.

Many different shapes for the adapter body could be used. Ornamental and functions forms could be added, such as thumb grips, company logos, and arrows. The adaptor body could be formed from plastic or metal or some combination. Personal computers may have 4 DP ports, or some other number of DP ports, with DP connectors oriented horizontally or vertically. The DP ports could be on other devices, such as a home theater, game, or communications device.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A swivel adapter comprising:

a wide connector for connecting to a video cable to a display device;

a narrow connector for connecting to a computer port, wherein the wide connector is wider than the narrow connector;

an adapter body;

a wide end of the adapter body, wherein the wide connector is supported by the wide end of the adapter body;

a narrow end of the adapter body, wherein the narrow connector is supported by the narrow end of the adapter body;

a swivel joint between the wide end and the narrow end of the adapter body, wherein the wide end is rotatable with respect to the narrow end when the wide end is rotated about the swivel joint; and a swivel mechanism connected across the swivel joint to rotatably join the wide end to the narrow end, wherein the wide connector is parallel to the narrow connector when the swivel mechanism is rotated into a first rotational position;

wherein the wide connector is perpendicular to the narrow connector when the swivel mechanism is rotated into a second rotational position;

a first circuit board disposed within the wide end of the adapter body, wherein terminals of the wide connector are electrically connected to signal traces on the first circuit board;

a second circuit board disposed within the narrow end of the adapter body, wherein terminals of the narrow connector are electrically connected to signal traces on the second circuit board; and a converter chip mounted on the first circuit board or mounted on the second circuit board, for converting signals from the narrow connector into signals for the wide connector, whereby the wide connector on the wide end is able to be rotated relative to the narrow connector on the narrow end of the adapter body.

2. The swivel adapter of claim 1 wherein the wide connector is perpendicular to the narrow connector when the swivel mechanism is rotated in a counter-clockwise direction into the second rotational position;

wherein the wide connector is perpendicular to the narrow connector when the swivel mechanism is rotated in a clockwise direction into a third rotational position.

3. The swivel adapter of claim 2 wherein the wide connector is rotated by 180-degrees between the second rotational position and the third rotational position.

4. The swivel adapter of claim 1 wherein the wide connector and the narrow connector are for carrying video signals.

5. The swivel adapter of claim 4 further comprising:

red, green, and blue signal lines in the wide connector for carrying red, green, and blue video signals;

red, green, and blue signal lines in the narrow connector for carrying red, green, and blue video signals, whereby red, green, and blue video signals are carried by the wide connector and by the narrow connector.

6. The swivel adapter of claim 5 further comprising:

a first clock signal line in the wide connector for synchronizing transfer of data signals in the wide connector;

a second clock signal line in the wide connector for synchronizing transfer of data signals in the wide connector, whereby data transfer is synchronized to clocks.

7. The swivel adapter of claim 4 wherein the wide connector is a Digital Visual Interface (DVI) connector.

8. The swivel adapter of claim 7 wherein the narrow connector is a Display Port (DP) connector.

9. The swivel adapter of claim 8 wherein S is a spacing between adjacent DP receptacles for computer ports on a host device;

wherein the wide end of the swivel adapter twists away from the spacing between an adjacent computer port to allow access to the adjacent computer port.

10. The swivel adapter of claim 1 further comprising:

a flexible cable between the first circuit board and the second circuit board, for carrying signals between the first and second circuit boards, wherein the flexible cable carries signals to and from the converter chip.

11. The swivel adapter of claim 10 wherein the flexible cable is twistable when the swivel mechanism is rotated.

12. The swivel adapter of claim 11 wherein the flexible cable fits through a central opening of the swivel mechanism.

13. The swivel adapter of claim 11 wherein the flexible cable comprises a plurality of separate wires, a cable of wires, or a flexible circuit board with wiring traces.

14. The swivel adapter of claim 1 wherein the swivel mechanism comprises:

a gear ring having a central opening;

a plurality of teeth formed on the gear ring along the central opening;

a spring;

a ball disposed between the spring and the gear ring;

wherein the spring forces the ball into gaps between teeth on the gear ring;

wherein the gear ring is rotatable by a user applying a twisting force that overcomes a spring force exerted by the spring.

15. The swivel adapter of claim 14 wherein the gear ring is attached to the wide end and the spring is attached to the narrow end of the adapter body near the swivel joint, or wherein the gear ring is attached to the narrow end and the spring is attached to the wide end of the adapter body near the swivel joint.

16. The swivel adapter of claim 14 wherein the gear ring and the swivel joint are circular.

17. The swivel adapter of claim 1 wherein the narrow connector has a first axis that is perpendicular to the narrow connector and located at a center of the narrow connector;

wherein the wide connector has a second axis that is perpendicular to the wide connector and located at a center of the wide connector;

wherein the first axis and the second axis are parallel and offset from each other;

wherein the second axis moves in an orbital fashion around the first axis as the wide end of the adapter body is twisted around the swivel joint, whereby offset connectors are twisted about each other in an orbital fashion.

18. An orbital-offset adapter comprising:

a first connector for connecting to tightly-spaced ports on a computer;

a second connector that is larger than the first connector;

a first body section having the first connector at a first end, and a swivel joint at an opposite end;

a first circuit board encased by the first body section and connected to the first connector;

a second body section having the second connector at a second end, and the swivel joint at an opposite end;

a second circuit board encased by the second body section and connected to the second connector; and a swivel mechanism, having a first portion attached to the first body section at the swivel joint, and a second portion attached to the second body section at the swivel joint, for twisting the first body section with respect to the second body section around the swivel joint;

wherein the first connector has a first axis that is perpendicular to the first connector and located at a center of the first connector;

wherein the second connector has a second axis that is perpendicular to the second connector and located at a center of the second connector;

wherein the first axis and the second axis are parallel and offset from each other;

wherein the second axis moves in an orbital fashion around the first axis as the first body section is twisted around the swivel joint, whereby offset connectors are twisted about each other in an orbital fashion.

19. A rotating video adapter comprising:

first video connector means for connecting video signals to tightly-spaced ports on a computer;

second video connector means for connecting video signals to a display device;

wherein the first video connector means is larger in cross-sectional area than the first video connector means;

first body means for supporting the first video connector means, having a swivel joint at an opposite end;

first circuit board means, encased by the first body means, for connecting to the first video connector means;

second body means for supporting the second video connector means, and having the swivel joint at an opposite end;

second circuit board means, encased by the second body means, for connecting to the second video connector means; and swivel means, having a first side attached to the first body means at the swivel joint, and a second side attached to the second body means at the swivel joint, for rotating the first body means with respect to the second body means around the swivel joint in response to a twisting force applied by a user;

wherein the first video connector means has a first axis that is perpendicular to the first video connector means and located at a center of the first video connector means;

wherein the second video connector means has a second axis that is perpendicular to the second video connector means and located at a center of the second video connector means;

wherein the first axis and the second axis are parallel and offset from each other;

wherein the swivel means is further for moving the second axis in an orbital fashion around the first axis as the first body means is twisted around the swivel joint, whereby video connectors are twisted about each other.

* * * * *